US008434264B2

(12) United States Patent
Bosserdet, Jr.

(10) Patent No.: US 8,434,264 B2
(45) Date of Patent: May 7, 2013

(54) ANIMAL DOOR HAVING AN ADJUSTABLE HEIGHT

(75) Inventor: James R. Bosserdet, Jr., Old Fort, TN (US)

(73) Assignee: Radio Systems Corporation, Knoxville, TN (US)

( * ) Notice: Subject to any disclaimer, the term of this patent is extended or adjusted under 35 U.S.C. 154(b) by 421 days.

(21) Appl. No.: 12/721,880

(22) Filed: Mar. 11, 2010

(65) Prior Publication Data

US 2011/0219693 A1 Sep. 15, 2011

(51) Int. Cl.
*E06B 7/28* (2006.01)
*E06B 3/26* (2006.01)

(52) U.S. Cl.
USPC ..... 49/169; 49/168

(58) Field of Classification Search ..... 49/168, 49/169, 402; 119/501
See application file for complete search history.

(56) References Cited

U.S. PATENT DOCUMENTS

| | | | | | |
|---|---|---|---|---|---|
| 2,748,854 | A | | 6/1950 | Lynch | |
| 2,758,646 | A | * | 8/1956 | Johnson | 160/354 |
| 3,499,246 | A | | 3/1970 | Loukas | |
| 3,918,203 | A | | 11/1975 | Ellison, Jr. | |
| 4,020,595 | A | | 5/1977 | Duncan | |
| 4,047,331 | A | * | 9/1977 | Davlantes | 49/171 |
| 4,173,099 | A | | 11/1979 | Robb | |
| 4,326,727 | A | | 4/1982 | Rock | |
| 4,408,416 | A | * | 10/1983 | Davlantes | 49/168 |
| 4,651,793 | A | * | 3/1987 | Davlantes | 160/92 |
| 4,754,797 | A | * | 7/1988 | Sronce | 160/354 |
| 5,185,954 | A | * | 2/1993 | Waddle, Sr. | 49/168 |
| 5,269,097 | A | * | 12/1993 | Davlantes | 49/169 |
| 5,287,654 | A | * | 2/1994 | Davlantes | 49/169 |
| 5,581,940 | A | | 12/1996 | Peterson | |
| 5,657,592 | A | | 8/1997 | Davlantes | |
| 5,735,079 | A | * | 4/1998 | Davlantes | 49/169 |
| 5,946,855 | A | * | 9/1999 | Miconi | 49/163 |
| 5,946,856 | A | * | 9/1999 | Davlantes | 49/168 |
| 5,992,096 | A | | 11/1999 | De La Cerda et al. | |
| 6,272,793 | B1 | | 8/2001 | Davlantes | |
| 6,385,909 | B1 | * | 5/2002 | Marsh et al. | 49/169 |
| 6,691,483 | B2 | | 2/2004 | Lethers | |
| 7,063,123 | B2 | * | 6/2006 | Lethers | 160/180 |
| 7,150,244 | B2 | | 12/2006 | Dawes | |
| 7,207,141 | B2 | | 4/2007 | Sullivan | |
| 7,284,502 | B1 | | 10/2007 | Dotter | |
| 7,363,956 | B2 | | 4/2008 | Lethers | |
| 2003/0233802 | A1 | | 12/2003 | Lethers | |
| 2007/0204514 | A1 | * | 9/2007 | Grimmett | 49/169 |
| 2010/0269413 | A1 | | 10/2010 | Sullivan | |

* cited by examiner

*Primary Examiner* — Katherine Mitchell
*Assistant Examiner* — Justin Rephann
(74) *Attorney, Agent, or Firm* — Pitts & Lake, PC

(57) ABSTRACT

Described is an animal door for enabling an animal to pass through a structure and for having an adjustable height. More specifically, the animal door is capable of being installed at the structure at multiple orientations, whereby the orientation at which the animal door is installed governs the height of the door. Additionally, the animal door is removably installed at the structure such that the orientation, and thus the height, of the door is adjustable.

14 Claims, 4 Drawing Sheets

ANIMAL DOOR HAVING AN ADJUSTABLE HEIGHT

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention pertains to an animal door for enabling an animal to pass through a structure. More particularly, this invention pertains to an animal door having an adjustable height with respect to the ground.

2. Description of the Related Art

Conventional pet doors are typically installed at a structure, such as a full-sized door, to enable a pet to traverse through the structure by way of the pet door. These pet doors typically include a frame and flap. The frame defines a passageway sufficient for a pet to pass through and is typically installed by first cutting a through-opening in the structure. The frame cooperates with the structure at the through-opening such that, when the frame is installed, the passageway is defined at the through-opening to the extent that the passageway provides a passage through the structure. The flap is disposed proximate the passageway and is movable between a closed position and an open position. When at the closed position, the flap substantially covers the passageway such that environmental elements do not pass therethrough. When at the open position, the flap permits the pet to pass through the passageway.

The through-opening is cut in the structure such that when the conventional pet door is installed, the height of the passageway is appropriate for the pet using the pet door. For example, the pet door should be installed at a height that permits the pet to access the pet door without having to jump or to uncomfortably crouch.

Conventional pet doors are limited in that the height of the passageway is not adjustable to account for a growing pet or a subsequent pet. For example, when a conventional pet door is installed to be used by a puppy, the height of the passageway becomes inappropriately low as the dog matures and increases in size. As another example, when a conventional pet door is installed to be used a taller pet, the height of the passageway becomes inappropriately high when a subsequent shorter pet is acquired. In circumstances such as these, a conventional pet door must be uninstalled and the through-opening must be modified such that the pet door can be reinstalled at the more appropriate height. More specifically, to adjust the height of a conventional pet door, additional cuts must be made in the structure to provide a though-opening at an appropriate height for proper installation of the pet door. As a result, the structure must be mended where the through-opening is no longer needed, which is aesthetically impossible in most circumstances and structurally impossible in some circumstances. Consequently, a pet door that provides a passageway having an adjustable height is desired.

BRIEF SUMMARY OF THE INVENTION

In accordance with the various features of the present invention there is provided an animal door for enabling an animal to pass through a structure and for having an adjustable height. The animal door includes a frame and a flap unit. The frame defines a first frame perimeter side and a second frame perimeter side. The frame also defines a passageway a first distance from the first frame perimeter side and a second distance from the second frame perimeter side, whereby the first distance is not equal to the second distance. The passageway is substantial to the extent that an animal is able to pass therethrough. The frame is removably installed at a structure that defines a through-opening such that the animal can pass through the through-opening, and thus the structure, by way of the passageway. The frame can be installed at the structure at a first orientation and at a second orientation. When the frame is installed at the first orientation, the first distance defines at least a portion of the height of the passageway, the height of the passageway being the distance between the passageway and the surface traversed by the animal, such as the ground. When the frame is installed at the second orientation, the second distance defines at least a portion of the height of the passageway. Because the first distance and the second distance are not equal, the height of the passageway when the frame is installed at the first orientation is different from the height of the passageway when the frame is installed at the second orientation. More specifically, the difference between the first distance and the second distance is equal to the difference between the height of the passageway when the frame is installed at the first orientation and the height of the passageway when the frame is installed at the second orientation. Additionally, because the frame is removably installed at the structure, it can be uninstalled and reinstalled at a different orientation. Accordingly, the height of the passageway, and in effect the animal door, is adjustable.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

The present invention provides an animal door for enabling an animal to pass through a structure and for having an adjustable height. More specifically, the animal door is capable of being installed at the structure at multiple orientations, whereby the orientation at which the animal door is installed governs the height of the door. Additionally, the animal door is removably installed at the structure such that the orientation, and thus the height, of the door is adjustable. An exploded view of one embodiment of the animal door constructed in accordance with the various features of the present invention is illustrated generally at 10 in FIG. 1.

Figure 1:
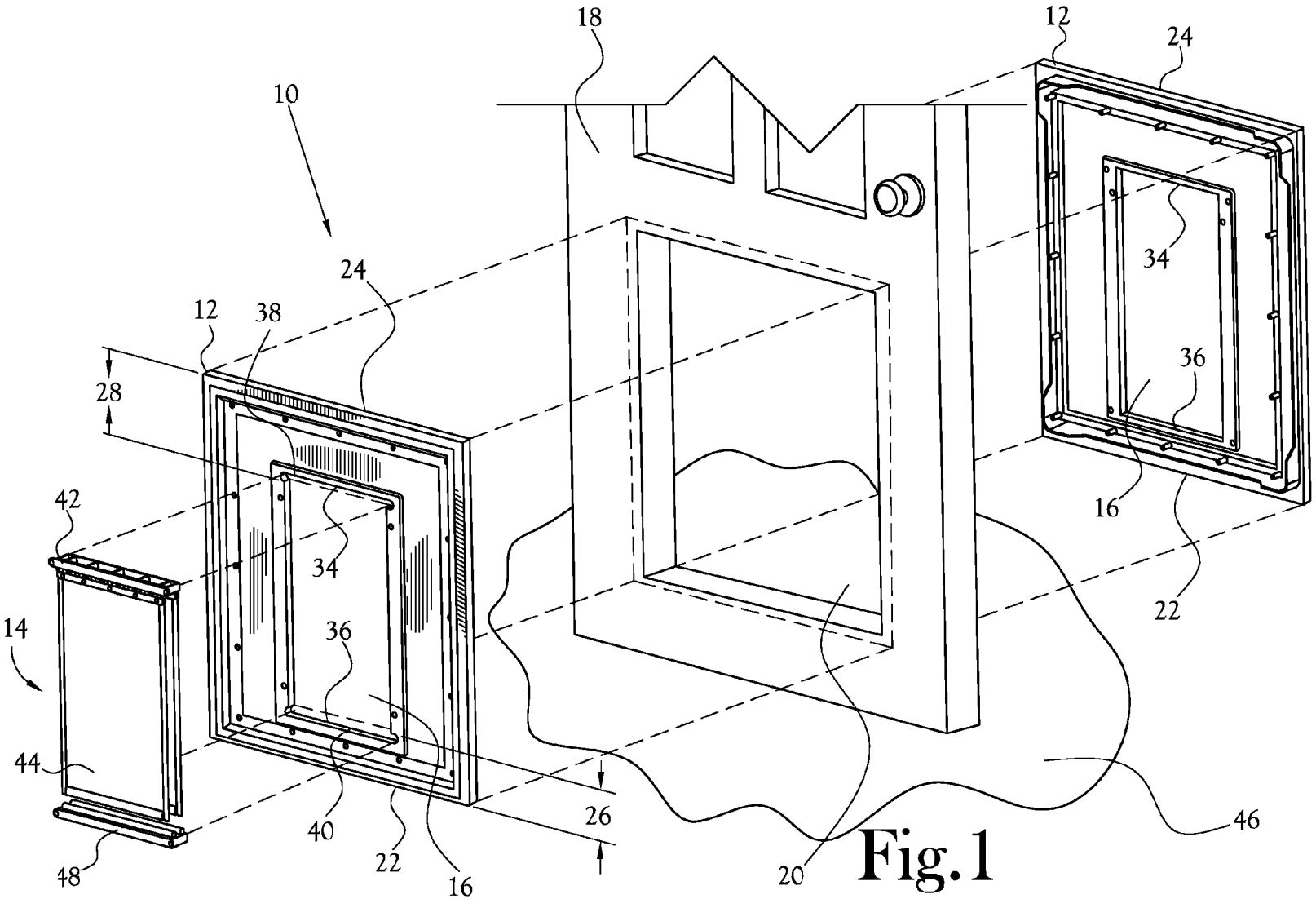
FIG. 1 is an exploded view of one embodiment of the animal door in accordance with the various features of the present invention.

The animal door 10 of FIG. 1 includes a frame 12 and a flap unit 14. The frame 12 defines a passageway 16 that is sufficient for an animal to pass through. The frame 12 cooperates with a structure 18 such that when installed at the structure 18, the frame 12 enables the animal to pass through the structure 18 by way of the passageway 16. More specifically, the structure 18 is any physical structure through which the animal is to have passage. For example, in FIG. 1, the structure 18 is a standard full-sized panel door. The structure 18 defines a through-opening 20. In many circumstances, a portion is taken from the structure 18 to create the through-opening 20. For example, in FIG. 1, the two bottom panels and the bottom mullion is removed from the panel door (the structure 18) to create the through-opening 20. The frame 12 cooperates with the structure 18 at the through-opening 20 such that when the frame 12 is installed, the passageway 16 is defined at the through-opening 20. Accordingly, the animal is able to pass through the through-opening 20, and thus the structure 18, by way of the passageway 16.

In the illustrated embodiment, the frame 12 includes a first frame member 32 and a second frame member 34. The first frame member 32 and the second frame member 34 are installed at opposite sides of the structure 18 and in accordance with the above discussion. In one embodiment, the first frame member 32 and the second frame member 34 are independently and removably secured directly to the structure 18 when the frame 12 is installed. In one embodiment, the first frame member 32 and the second frame member 34 are removably secured to one another within or proximate the through-opening 20 when the frame 12 is installed.

The perimeter of the frame 12 includes at least two designated perimeter sides, namely a first frame perimeter side 22 and a second frame perimeter side 24. In the illustrated embodiment, the first frame perimeter side 22 is positioned opposite the second frame perimeter side 24 with respect to the passageway 16. However, it should be noted that the first frame perimeter side 22 need not be positioned opposite the second frame perimeter side 24 to remain within the scope or spirit of the present invention. The passageway 16 is defined a first distance 26 from the first frame perimeter side 22 and a second distance 28 from the second frame perimeter side 24, whereby the first distance 26 is a lesser distance than the second distance 28. As a result, the passageway 16 is not defined at the center of the frame 12 but closer to the first frame perimeter side 22 than the second frame perimeter side 24.

Figure 4:
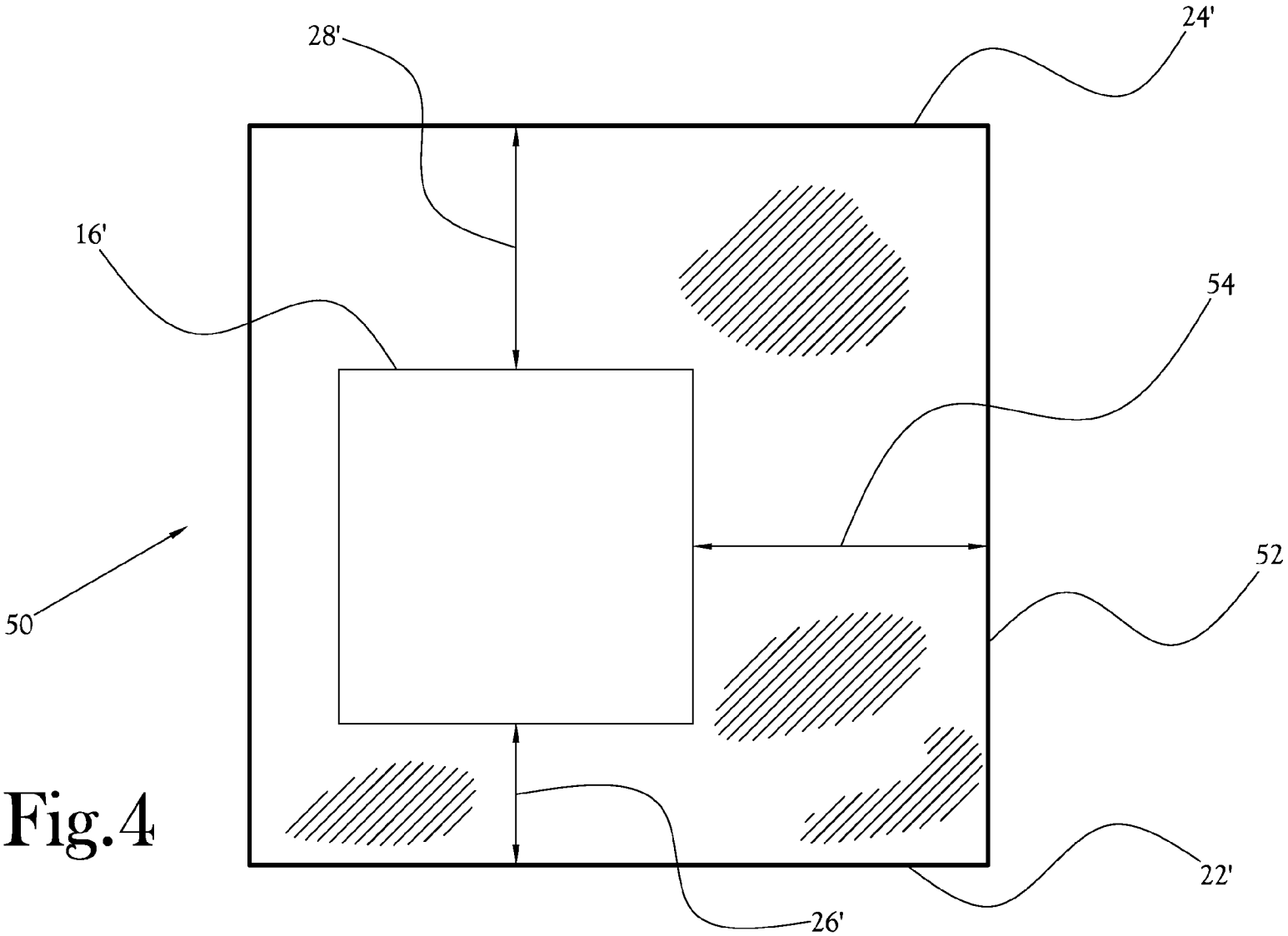
FIG. 4 is a diagram illustrating an example embodiment of a frame having a third installable orientation.

It should be noted that the perimeter of the frame 12 can include a designated perimeter side in addition to the first frame perimeter side 22 and the second frame perimeter side 24 without departing from the scope or spirit of the present invention. For example, the frame 12 of FIG. 1 can have a third frame perimeter side that runs between the first frame perimeter side 22 and the second frame perimeter side 24. In this embodiment, the passageway 16 is defined a third distance from the third frame perimeter side, whereby the third distance is a greater distance than the second distance 28. As a result, the passageway 16 is defined closer to both the first frame perimeter side 22 and the second frame perimeter side 24 than it is to the third frame perimeter side 30. FIG. 4 is a diagram illustrating an example embodiment having such a third frame perimeter side and third installable orientation, wherein the frame 50 has a third frame perimeter side 52, the frame 50 defining a passageway 16' a third distance 54 from the third frame perimeter side 52 the third distance 54 not being equal to the first distance 26' or the second distance 28' said frame being installable at the structure at a third orientation such that the third distance 54 defines at least a portion of the height of the passageway 16' when the frame 50 is installed at the third orientation.

The frame 12 is removably installed at the structure 18 in accordance with the above discussion. Additionally, the frame 12 is structured to be installed at least two orientations. More specifically, for each designated frame perimeter side, the frame 12 is capable of an orientation. Each orientation is defined by the height h of the passageway 16 with respect to the surface 46 traversed by the animal when the frame 12 is installed at that orientation. The surface 46 is typically the ground or a floor and is typically the surface that supports, either directly or indirectly, the structure 18. Accordingly, each orientation is defined by the frame perimeter side that is most proximate, and typically substantially parallel, to the surface 46 such that the height h of the passageway 16 is at least partially defined by the distance between the passageway 16 and the frame perimeter side. Considering the illustrated embodiment, the frame 12 is structured to be installed at two orientations, namely a first orientation and a second orientation.

Figure 2:
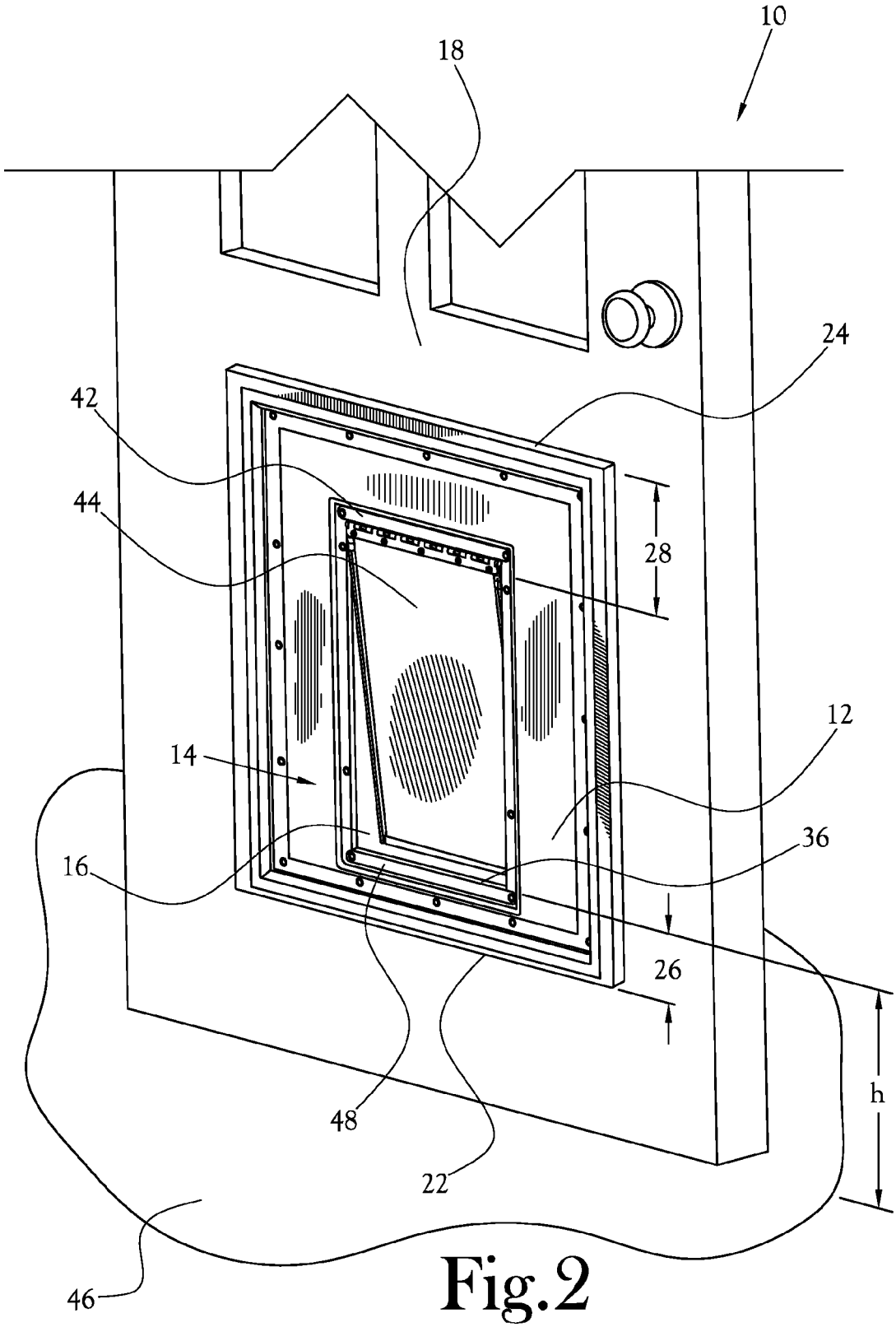
FIG. 2 illustrates the animal door installed at the first orientation.
Figure 3:
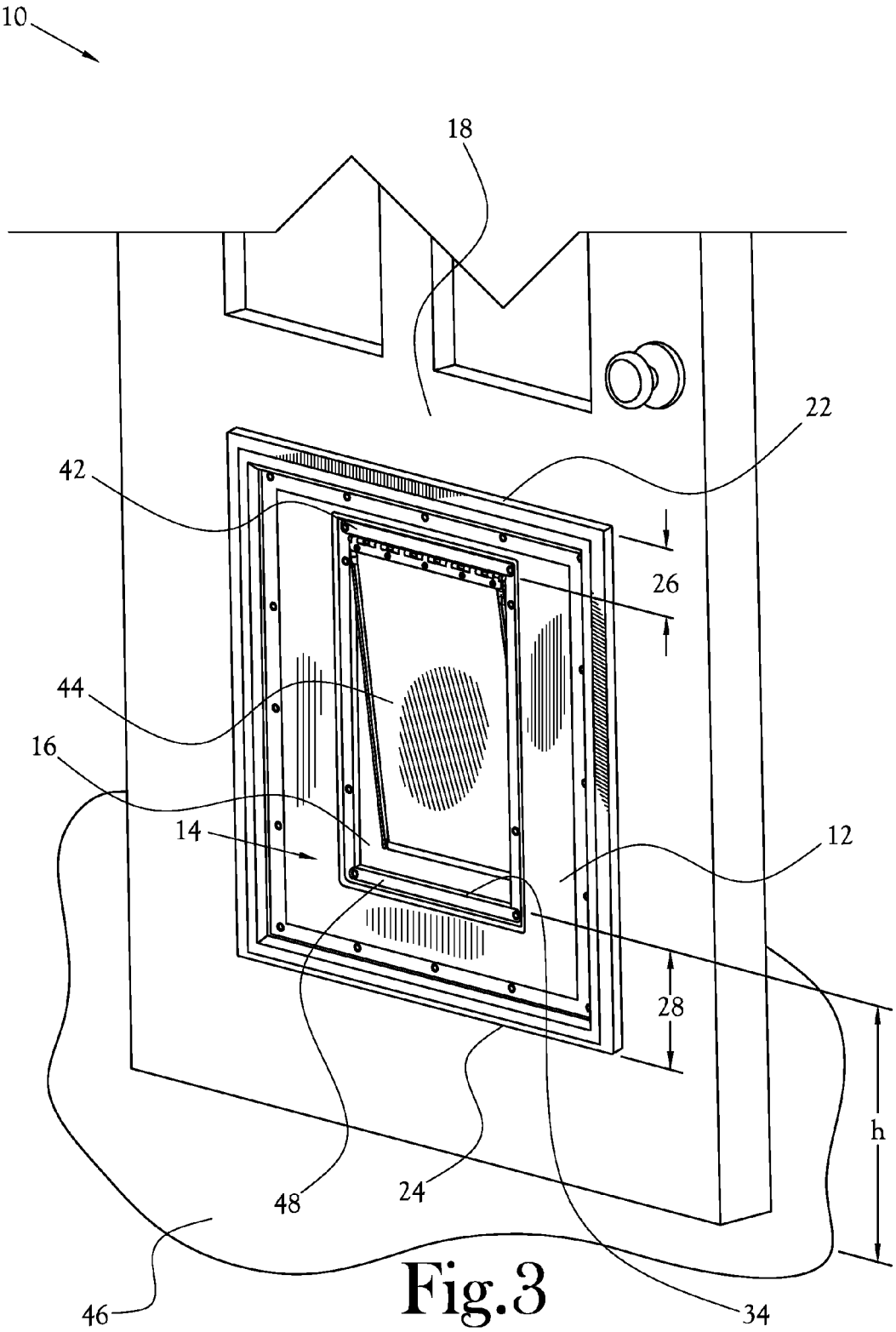
FIG. 3 illustrates the animal door installed at the second orientation.

FIG. 2 illustrates the frame 12 installed at the structure 18 at the first orientation. When the frame 12 is installed at the first orientation, the first frame perimeter side 22 is most proximate and substantially parallel to the surface 46 such that the first distance 26 partially defines the height of the passageway 16 with respect to the surface 46, this height being labeled h. FIG. 3 illustrates the frame 12 installed at the structure 18 at the second orientation. When the frame is installed at the second orientation, the second frame perimeter side 24 is most proximate and substantially parallel to the surface 46 such that the second distance 28 partially defines the height of the passageway 16 with respect to the surface 46, this height being labeled h. As discussed above, the first distance 26 and the second distance 28 are not equal distances. Accordingly, the height h of the passageway 16 when the frame 12 is installed at the first orientation is different from the height h of the passageway 16 when the frame 12 is installed at the second orientation. More specifically, the difference between the first distance 26 and the second distance 28 is equal to the difference between the height h of the passageway 16 when the frame 12 is installed at the first orientation and the height h of the passageway 16 when the frame 12 is installed at the second orientation. Accordingly, the orientation of the frame 12 governs the height h of the passageway 16. Along these lines, the height h of the passageway 16 is adjusted by adjusting the orientation of the frame 12. Because the frame 12 is removably installed at the structure 18, the orientation of the frame 12 is adjusted by uninstalling the frame 12 and reinstalling the frame 12 at a different orientation. In the illustrated embodiment, the height of the passageway 16 is adjusted by uninstalling the frame 12, rotating the frame 12 180°, and reinstalling the frame 12. In view of the above-discussed features, the height h of the passageway 16, and in effect the height of the animal door 10, is adjustable and is adjusted without any modification to the through-opening 20.

In the illustrated embodiment of FIG. 1, the perimeter of the passageway 16 includes a designated perimeter side for each designated frame perimeter side. Accordingly, in the illustrated embodiment, the passageway 16 includes a first passageway perimeter side 34 and a second passageway perimeter side 36. Each passageway perimeter side is defined opposite its respective frame perimeter side with respect to the passageway 16. More specifically, in the illustrated embodiment, the first passageway perimeter side 34 is defined opposite the first frame perimeter side 22 with respect to the passageway 16, and the second passageway perimeter side 36 is defined opposite the second frame perimeter side 24 with respect to the passageway 16. A flap unit receptor is disposed at each passageway perimeter side. Accordingly, a first flap unit receptor 38 is disposed at the first passageway perimeter side 34, and a second flap unit receptor 40 is disposed at the second passageway perimeter side 36. Each flap unit receptor is adapted to receive the flap unit 14.

The flap unit 14 includes a flap base 42 and a flap 44 secured thereto. The flap base 42 is received by the flap unit receptor corresponding to the current orientation of the frame 12. For example, in the illustrated embodiment, the flap base 42 is received by the first flap unit receptor 38 when the frame 12 is installed at the first orientation and is received by the second flap unit receptor 40 when the frame 12 is installed at the second orientation. When the flap unit 14 is received by one of the flap unit receptors, the flap 44 depends from the flap base 42 and is movable between a closed position and an open position. The flap 44 substantially obstructs the passageway 16 when at the closed position, preventing, for example, environmental elements from passing through the passageway 16. In one embodiment, the flap 44 generates a weatherproof seal with the frame 12 at the passageway 16 when at the closed position. The flap 44 permits the animal to pass through the passageway 16 when at the open position. In the illustrated embodiment, the flap 44 depends from the flap base 42 by way of a hinge member such that it is bidirectionally movable between the closed and the open position. In one embodiment, the flap 44 is moved from the closed position to the open position by the animal.

In the illustrated embodiment, the animal door 10 includes a filler unit 48. The filler unit 48 is adapted to be received by the flap receptor not occupied by the flap unit 14. For example, when the frame 12 of FIG. 1 is installed at the first orientation, the first flap receptor 38 receives the flap unit 14 and the second flap receptor 40 receives the filler unit 48. Conversely, when the frame 12 is installed at the second orientation, the second flap receptor 40 receives the flap unit 14 and the first flap receptor 38 receives the filler unit 48. The filler unit 48 protects the unoccupied receiving flap receptor from damage caused by debris and moisture. It should be noted that when the animal door 10 has more than two flap receptors, the animal door 10 includes a filler unit 48 for each flap receptor not occupied by the flap unit 14.

From the foregoing description, those skilled in the art will recognize that an animal door for enabling an animal to pass through a structure offering advantages over the prior art has been provided. More specifically, the animal door is capable of being installed at the structure at multiple orientations, whereby the orientation at which the animal door is installed governs the height of the door. Additionally, the animal door is removably installed at the structure such that the orientation, and thus the height, of the door is adjustable.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, what is claimed is:

1. An animal door having an adjustable height, said animal door comprising:

a frame having a first frame perimeter side and a second frame perimeter side, said frame having first and second frame surfaces to define a passageway a first distance from the first frame perimeter side and a second distance from the second frame perimeter side, the first distance not being equal to the second distance, said frame being removably installable at a structure having a first structure surface and a second structure surface opposite the first structure surface that define a through-opening, the first frame surface being installed to the first structure surface and the second frame surface being installed to the second structure surface, an animal being able to pass through the through-opening by way of the passageway when said frame is installed at the structure, said frame being installable at a first orientation and a second orientation without modification to the through-opening such that the first and second frame surfaces are respectively maintained at the first and second structure surfaces at both the first and second orientations, the first distance defines at least a portion of a height of the passageway when said frame is installed at the first orientation, the second distance defines at least a portion of the height of the passageway when said frame is installed at the second orientation, the height of the passageway being the distance between the passageway and a surface traversed by the animal, the difference between the first distance and the second distance being equal to the difference between the height of the passageway when said frame is installed at the first orientation and the height of the passageway when said frame is installed at the second orientation.

2. The animal door of claim 1 further comprising a flap unit having a flap base and a flap, the flap base is removably secured to said frame, the flap depends from the flap base and is movable between a closed position and an open position, the flap substantially obstructs the passageway when at the closed position, the flap permits the animal access to the passageway when at the open position.

3. The animal door of claim 2 further comprising a first flap receptor and a second flap receptor, said first flap receptor being disposed at a first passageway perimeter side, the first passageway perimeter side being positioned opposite the first frame perimeter side with respect to the passageway, said second flap receptor being disposed at a second passageway perimeter side, the second passageway perimeter side being positioned opposite the second frame perimeter side with respect to the passageway, said first flap receptor removably receives the flap base when said frame is installed at the first orientation, said second flap receptor removably receives the flap base when said frame is installed at the second orientation.

4. The animal door of claim 3 further comprising a filler unit, said first flap receptor receives said filler unit when said frame is installed at the second orientation, said second flap receptor receives said filler unit when said frame is installed at the first orientation.

5. The animal door of claim 1 wherein said frame has a third frame perimeter side, said frame defines the passageway a third distance from the third frame perimeter side, the third distance not being equal to the first distance or the second distance, said frame being installable at the structure at a third orientation, the third distance defines at least a portion of the height of the passageway when said frame is installed at the third orientation.

6. The animal door of claim 1 wherein the surface traversed by the animal supports the structure.

7. An animal door having an adjustable height, said animal door comprising:

a frame having first and second frame surfaces to define:

a first frame perimeter side and a second frame perimeter side;

a passageway a first distance from said first frame perimeter side and a second distance from said second frame perimeter side, the first distance not being equal to the second distance;

a first passageway perimeter side and a second passageway perimeter side, said first passageway perimeter side being defined opposite said first frame perimeter side with respect to said passageway, said second passageway perimeter side being defined opposite said second frame perimeter side with respect to said passageway;

said frame being removably installable at a structure having a first structure surface and a second structure surface opposite the first structure surface that define a through-opening, the first frame surface being installed to the first structure surface and the second frame surface being installed to the second surface, an animal being able to pass through the through-opening by way of said passageway when said frame is installed at the structure, said frame being installable at a first orientation and a second orientation without modification to the through-opening such that the first and second frame surfaces are respectively maintained at the first and second structure surfaces at both the first and second orientations, the first distance defines at least a portion of a height of said passageway when said frame is installed at the first orientation, the second distance defines at least a portion of the height of said passageway when said frame is installed at the second orientation, the height of said passageway being the distance between said passageway and a surface traversed by the animal, the difference between the first distance and the second distance being equal to the difference between the height of said passageway when said frame is installed at the first orientation and the height of said passageway when said frame is installed at the second orientation, a flap unit having a flap base and a flap;

a first flap receptor disposed at said first passageway perimeter side and a second flap receptor disposed at said second passageway perimeter side, said first flap receptor removably receives the flap base when said frame is installed at the first orientation, said second flap receptor removably receives the flap base when said frame is installed at the second orientation, the flap depends from the flap base when the flap base is received by either said first flap receptor or said second flap receptor and is movable between a closed position and an open position, the flap substantially obstructs said passageway when at the closed position, the flap permits the animal access to said passageway when at the open position.

8. The animal door of claim 7 further comprising a filler unit, said first flap receptor receives said filler unit when said frame is installed at the second orientation, said second flap receptor receives said filler unit when said frame is installed at the first orientation.

9. The animal door of claim 7 wherein said frame has a third frame perimeter side, said frame defines the passageway a third distance from the third frame perimeter side, the third distance not being equal to the first distance or the second distance, said frame being installable at the structure at a third orientation, the third distance defines at least a portion of the height of the passageway when said frame is installed at the third orientation.

10. A method for adjusting a height of the animal door of claim 1, said method comprising the steps of:

providing a frame having a first frame perimeter side and a second frame perimeter side, said frame defining a passageway a first distance from the first frame perimeter side and a second distance from the second frame perimeter side, the first distance not being equal to the second distance, the passageway being substantial to the extent that an animal is able to pass therethrough;

removably installing the frame at a structure at a first orientation, the structure defining a through-opening, the animal being able to pass through the through-opening by way of the passageway when the frame is installed at the first orientation, the first distance defining at least a portion of the height of the passageway when the frame is installed at the first orientation; uninstalling the frame from the structure; and removably installing the frame at the structure at a second orientation, the animal being able to pass through the through-opening by way of the passageway when the frame is installed at the second orientation, the second distance defining at least a portion of the height of the passageway when the frame is installed at the second orientation.

11. The method of claim 10 wherein the height of the passageway is the distance between the passageway and the surface traversed by the animal such that the difference between the first distance and the second distance is equal to the difference between the height of the passageway when the frame is installed at the first orientation and the height of the passageway when the frame is installed at the second orientation.

12. The method of claim 10 wherein said steps of removably installing the frame does not include modifying the through-opening.

13. The method of claim 10 wherein said step of providing includes providing a frame having a third frame perimeter side, the frame defines the passageway a third distance from the third frame perimeter side, the third distance not being equal to the first distance or the second distance.

14. The method of claim 13 further comprising the step of removably installing the frame at a third orientation, the animal being able to pass through the through-opening by way of the passageway when said frame is installed at the third orientation, the third distance defines at least a portion of the height of the passageway when the frame is installed at the third orientation.

* * * * *